United States Patent [19]

Brown

[11] 4,280,239

[45] Jul. 28, 1981

[54] SELF RIGHTING, AUTOMATICALLY INFLATABLE LIFE RAFT

[75] Inventor: Eugene W. Brown, North Canton, Ohio

[73] Assignee: The B. F. Goodrich Company, Akron, Ohio

[21] Appl. No.: 98,562

[22] Filed: Nov. 29, 1979

Related U.S. Application Data

[63] Continuation of Ser. No. 889,590, Mar. 23, 1978, abandoned.

[51] Int. Cl.[3] ..... B63C 9/22

[52] U.S. Cl. ..... 9/11 A

[58] Field of Search ..... 9/2 A, 11 A, 11 R

[56] References Cited

FOREIGN PATENT DOCUMENTS 402572 3/1943 Italy ..... 9/11 A 902162 7/1962 United Kingdom ..... 9/11 A

*Primary Examiner*—Sherman D. Basinger

*Attorney, Agent, or Firm*—Michael J. Colitz, Jr.

[57] ABSTRACT

A life raft having an attached container of carbon dioxide for automatic inflation and with a separable strap temporarily constraining the raft at a central portion whereby inflation will occur in a sequence to properly position the floating raft, before the inflation pressure separates the strap, to ensure deployment in a self-righted orientation.

1 Claim, 6 Drawing Figures

SELF RIGHTING, AUTOMATICALLY INFLATABLE LIFE RAFT

This application is a continuation of application Ser. No. 889,590, filed Mar. 23, 1978, now abandoned.

BACKGROUND OF THE INVENTION

This invention relates to automatically inflatable life rafts. More particularly, this invention relates to the construction of automatically inflatable life rafts to ensure their inflation in the water in a proper, non-inverted, orientation.

There are many types of automatically inflatable life rafts in use today. One of the more popular types is that which is packed in a separable, two-piece rigid container. For deployment, the containerized raft is tossed into the water where it will float. A lanyard extending from the raft is yanked to activate the carbon dioxide cylinder valve to inflate the raft. Inflation enlarges the raft to separate the container sections and render the raft ready for use. Unfortunately, however, if the container is tossed into the water upside down, the raft will inflate in an inverted orientation. Turning the raft over to the right or erect orientation is a difficult task, particularly if the raft is large, the water is choppy or during a time of emergency. Since life rafts are often used in times of emergency, the likelihood of tossing the container into the water upside down is greatly increased.

SUMMARY OF THE INVENTION

It is therefore an object of the instant invention to deploy automatically inflatable life rafts in a proper, erect orientation.

It is a further object of the invention to automatically inflate life rafts so as to prohibit upside down deployment.

Still a further object of the present invention is to encompass and restrict a central portion of an automatically inflatable life raft with a strap and breakable string so that remote portions of the raft will inflate before breaking of the string to ensure self-righting of the raft in the water.

Another object of the present invention is to package an automatically inflatable life raft in separable container sections with the carbon dioxide bottle positioned at a central portion of the raft and with a breakable strap constricting a portion of the raft so that inflation will be sequentially controlled to ensure self-righting deployment.

In order to gain a better understanding of the invention, as well as other objects and further features thereof, reference is made to the following detailed description to be read in conjunction with the accompanying drawings.

DETAILED DESCRIPTION

Figure 1:
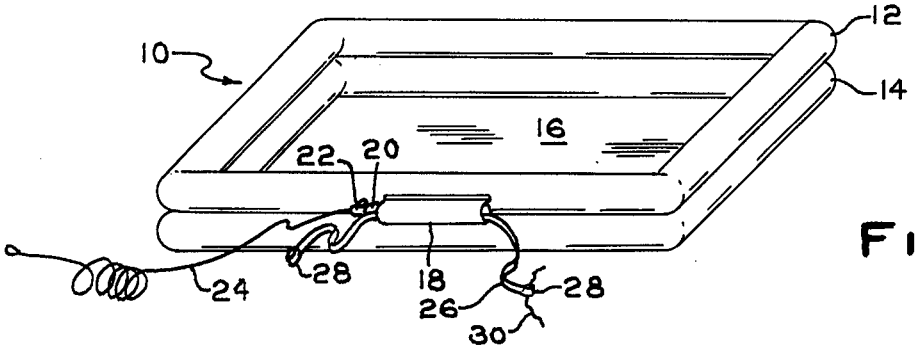
FIG. 1 is a view in perspective of the life raft of the present invention shown inflated in proper orientation.

Shown in FIG. 1 is an inflated life raft constructed in accordance with the instant invention. In the preferred embodiment, the raft 10 includes two rectangular inflatable sections, upper section 12 and lower section 14 suitably coupled. The sections have circular cross sectional configurations and constitute side walls of the inflated raft. A floor 16 is attached in water-tight fashion to the bottom of lower section 14. Sleeve 18 is attached to the sections adjacent one side for holding the carbon dioxide bottle in proper position. All of the above-mentioned parts are formed of a nylon fabric coated with an impervious rubber material.

Automatic inflation of the life raft 10 is provided by carbon dioxide under pressure in bottle 20 secured in position within sleeve 18. Any bottle or source of suitable compressed fluid could be utilized. Valve 22 couples the bottle to the raft sections 12 and 14. Activation of the valve to inflate the raft is done remotely by a long lanyard 24 extending from the valve to the vessel from which the raft is tossed.

Also secured within sleeve 18 is a strap 26 having a loop 28 at each end. The loops are provided to hold a string 30 which will break at a predetermined pressure as applied by the inflation of the raft.

Figure 2:
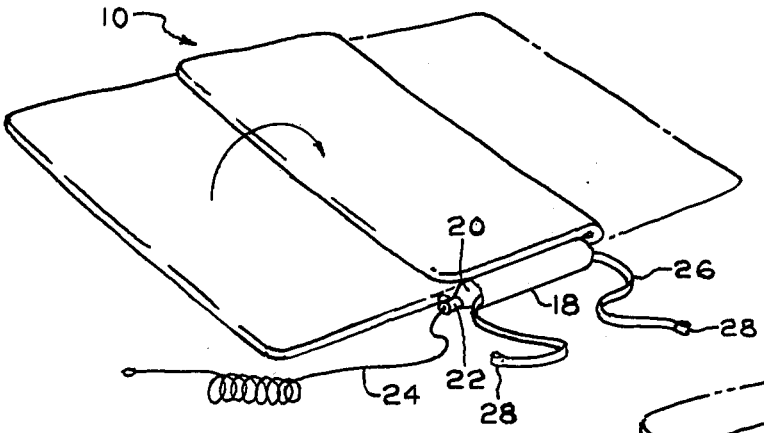
FIGS. 2 and 3 also show the life raft in perspective but in the deflated state being folded.
Figure 3:
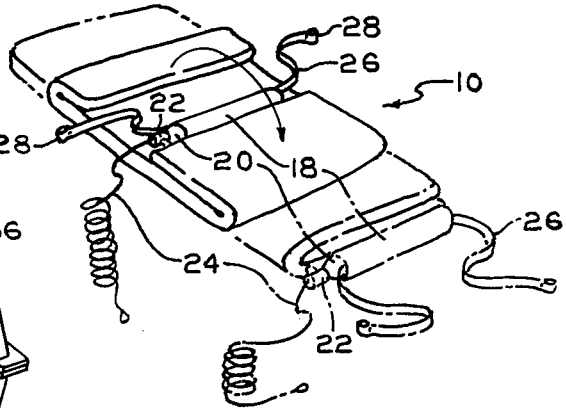
Figure 4:
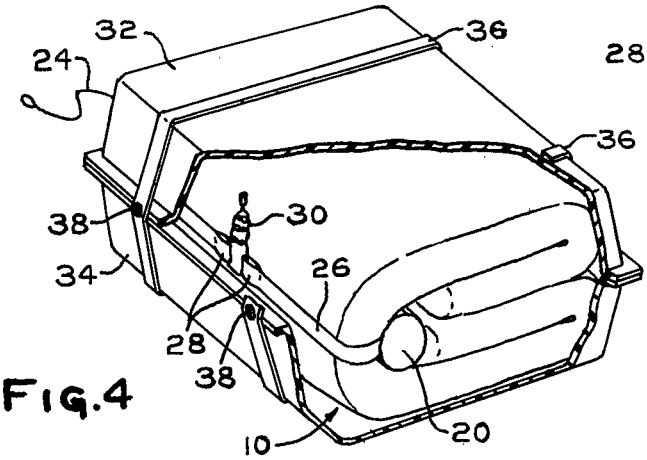
FIG. 4 is a perspective view of the life raft packaged for use in separable container sections.

A preferred method of packing the life raft is shown in FIGS. 2 through 4. FIG. 2 shows the front end of the deflated raft folded with an arrow indicating the rear end to be folded over both the front end and central third portion of the raft. Folding of the sides is shown in FIG. 3 wherein the bottle-containing side has been folded to locate the bottle in the middle of the previously folded raft sections. The opposite side of the raft is also shown as folded once and an arrow indicates the last fold to be made whereby the completely folded raft will be in fourths, configured as shown in FIG. 4.

Care must be taken in folding the life raft so as not to conceal straps 26 which must be wrapped around the underside of the folded raft as viewed in FIG. 3 to encompass the central raft section temporarily as will be later explained. The straps are more clearly seen in FIG. 4 along with string 30 which is tied in a secure knot so as to break under a predetermined pressure rather than slip. FIG. 4 also shows the container in which the raft is stored, with part broken away to show its contents.

The entire life raft, in its folded, non-inflated state, is positioned in a container having separable upper and lower halves 32 and 34. They are preferably constructed of a rigid, molded, plastic material. The container is the storage home for the life raft in anticipation of deployment. The container halves are held together by metal straps 36, each of which has a particularly sized aperture 38 to permit simultaneous breakage of both straps at a predetermined pressure as applied by raft inflation from within. The lanyard 24 extends from the bottle valve through a hole in the container halves so that deployment and self-righting inflation can be initiated from a remote location.

The life raft is stored in its rigid container on the vessel from which it is to be deployed. Folding the raft is previously done in the manner described above. The lanyard extends from interior of the container to exterior thereof. Only a few feet of its entire length is exposed, sufficient for attachment to the vessel. The remainder is coiled within the container to be withdrawn as the container is tossed into the water for use and yanked.

To utilize the life raft, it is first tossed from the vessel where it had been stored. The container and its contents will float until the lanyard 24 is yanked sufficiently to activate the valve 22. Thereupon the pressurized carbon dioxide will find a passageway through the valve into raft sections 12 and 14 to initiate inflation in a sequential manner. The carbon dioxide is at about 2100 psi within the bottle. Upon raft inflation a force of about 200 lbs. is rapidly placed upon straps 36 whereby they will break. This takes about two seconds from yanking. The container halves thus become unconstrained and will float free from the inflating raft. The partially inflated raft will then be assuming a position as that shown in FIG. 5. It will be inverted if the container has been deployed inverted. Inflation begins at the side adjacent the valve 22 and bottle 20 but quickly begins inflating all areas to the side opposite therefrom through the somewhat constricted central portion. Inflation of the central section is temporarily constricted and constrained due to the presence of strap 26 and string 30 but not in an amount to preclude carbon dioxide to reach the opposite side of the raft.

Continued inflation of the raft with the central section being restricted continues for about an additional five seconds until sufficient pressure of about 100 lbs. will break the string to separate the strap and thereby permit total inflation in the orientation of FIG. 1 whereupon the pressure of the bottle equals the pressure of the inflatable life raft sections at about two psi. The entire inflation takes about 12 seconds. Other temporary securing means with a controlled break point may be utilized in place of the strap and string.

Figure 6:
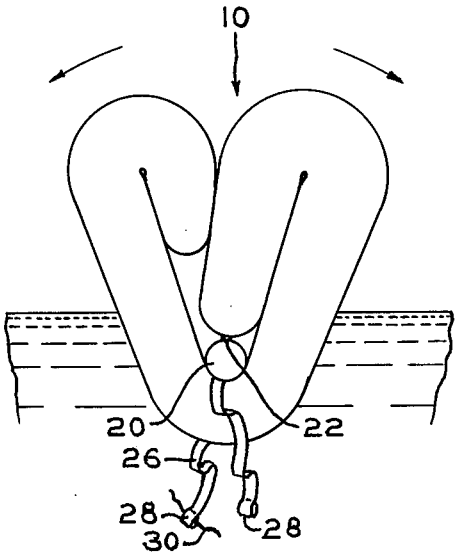

Immediately prior to the breaking of the temporary securing string, the unrestricted sections of the raft have been inflated sufficiently to billow upwardly and outwardly. This action, coupled with the weight of the bottle held at the constrained central section of the raft will compel the raft to assume the position as shown in FIG. 6. The breaking of the string will supplement the forces of inflation to throw outwardly the opposite sides of the raft including the bottle. It is this combination of inflation forces, bottle weight and strap constriction which ensure the self-righting of the life raft and non-inverted inflation.

Figure 5:
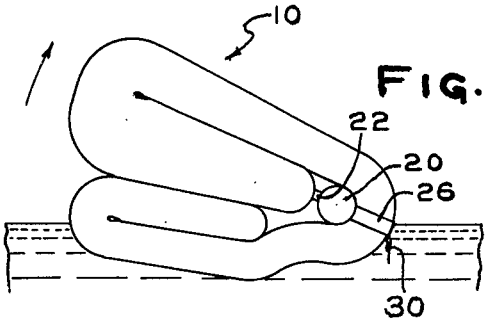
FIGS. 5 and 6 are end views of the life raft during stages of inflation.

Without the features of the present invention, the raft could be deployed upside down, inverted, or else right side up, erect, as a function of how the container was tossed into the water. For example, if the container were tossed into the water upside down, as shown in FIG. 5, and strap 26 were not employed, it is clear that the raft would always inflate inverted. Conversely, if the container were tossed into the water right side up, 180 degrees from the illustration of FIG. 5, and even if strap 26 were not employed, it is clear that the raft would always inflate properly. But with the construction of the present invention, the inflating raft must always assume the position of FIG. 6 during inflation regardless of its orientation at the initiation of inflation, regardless of how the container is tossed into the water.

The instant invention is capable of other modifications and adaptations by those having ordinary skill in the art and is more particularly defined by the appended claims.

What is claimed is:

1. In combination, a raft container formed of separable sections, a life raft having circumferential inflatable side walls and a floor folded within said container, a source of compressed gas, a sleeve securing said source of compressed gas to one wall of said life raft, valve means coupling said inflatable side walls and said source of compressed gas, strap means secured to said sleeve and separably encompassing a central portion of said folded life raft around said inflatable side walls adjacent said source of compressed gas to temporarily restrict inflation around the encompassed portion, said strap means including a breakable string separable upon continued inflation of said inflatable side walls, and a lanyard extending from said valve means to exterior of said container whereby a yank on said lanyard will activate said valve means to inflate said raft to sequentially separate the sections of said container to free said raft therefrom, then further inflate the non-central portions of said side walls to position said raft in a self-righting orientation, then further inflate said raft to break said string to eliminate the inflation restriction and complete inflation of the raft in the proper erect orientation.

* * * * *